US007397187B2

(12) United States Patent
Kwon et al.

(10) Patent No.: US 7,397,187 B2
(45) Date of Patent: Jul. 8, 2008

(54) PLASMA DISPLAY PANEL WITH ELECTRODE CONFIGURATION

(75) Inventors: Jae-Ik Kwon, Suwon-si (KR); Kyoung-Doo Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 10/929,384

(22) Filed: Aug. 31, 2004

(65) Prior Publication Data

US 2005/0052137 A1 Mar. 10, 2005

(30) Foreign Application Priority Data

Sep. 4, 2003 (KR) ..... 10-2003-0061840

(51) Int. Cl.
*H01J 17/49* (2006.01)

(52) U.S. Cl. ..... 313/583; 313/584

(58) Field of Classification Search ..... 313/583, 313/584

See application file for complete search history.

(56) References Cited

U.S. PATENT DOCUMENTS

| | | | | |
|---|---|---|---|---|
| 4,999,539 | A * | 3/1991 | Coovert et al. | 313/505 |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,285,128 | B1 * | 9/2001 | Amemiya | 313/582 |
| RE37,444 | E | 11/2001 | Kanazawa | |
| 6,343,967 | B1 * | 2/2002 | Nishiki et al. | 445/24 |
| 6,373,190 | B1 * | 4/2002 | Tsuruoka et al. | 313/582 |
| 6,373,195 | B1 * | 4/2002 | Whang et al. | 313/584 |

(Continued)

FOREIGN PATENT DOCUMENTS

JP 60-059632 4/1985

(Continued)

OTHER PUBLICATIONS

Machine translation of Tsuruoka.*

(Continued)

*Primary Examiner*—Peter J Macchiarolo
(74) *Attorney, Agent, or Firm*—Robert E. Bushnell, Esq.

(57) ABSTRACT

The AC plasma display panel (PDP) has electrodes arranged to correspond to each discharge cell between two substrates, address electrodes for the selection of display cells are formed on one substrate, and a pair of display electrodes for display discharge are formed on the other substrate. The plasma display panel includes a first substrate and a second substrate opposing each other; display electrodes formed along one direction on the first substrate, being parallel to one another; address electrodes formed on the second substrate along the direction intersecting the display electrodes, and being parallel to one another; barrier ribs arranged in the space between the first substrate and the second substrate to define a plurality of discharge cells; and phosphor layers formed in each of the discharge cells. Then, expanded portions are formed in the regions of the address electrodes that correspond to the outermost discharge cells adjacent to the edges of both of the substrates.

21 Claims, 7 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 6,903,709 | B2 * | 6/2005 | Kawasaki et al. | 345/60 |
| 2001/0017519 | A1 * | 8/2001 | Yonehara et al. | 313/582 |
| 2004/0239246 | A1 * | 12/2004 | Asida et al. | 313/582 |
| 2005/0052137 | A1 * | 3/2005 | Kwon et al. | 313/584 |
| 2006/0108925 | A1 * | 5/2006 | Hur et al. | 313/583 |

FOREIGN PATENT DOCUMENTS

| | | | |
|---|---|---|---|
| JP | 02-148645 | | 6/1990 |
| JP | 2845183 | | 10/1998 |
| JP | 2917279 | | 4/1999 |
| JP | 11306993 | A * | 11/1999 |
| JP | 2001-043804 | | 2/2001 |
| JP | 2001-325888 | | 11/2001 |
| JP | 2006216254 | A * | 8/2006 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

U.S. Appl. No. 10/929,626 to Jae-Ik Kwon et al., entitled *Plasma Display Panel*, which is concurrently filed with this application.

* cited by examiner

PLASMA DISPLAY PANEL WITH ELECTRODE CONFIGURATION

CROSS REFERENCE TO RELATED APPLICATION

This application relates to a U.S. patent application which is concurrently submitted to the U.S. Patent & Trademark Office with this application, and which is based upon a Korean Priority Ser. No. 2003-61838 entitled PLASMA DISPLAY PANEL filed in the Korean Industrial Property Office on 4 Sep. 2003. The related application is incorporated herein by reference in its entirety.

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 4 Sep. 2003 and there duly assigned Ser. No. 2003-61840.

BACKGROUND OF THE INVENTION

1. Field of the Invention

The present invention relates to a plasma display panel (PDP), and more particularly to an AC (Alternating Current) PDP with an electrode configuration, wherein electrodes are arranged to correspond to each discharge cell between two substrates, the electrodes including address electrodes for the selection of display cells and a pair of display electrodes for display discharge.

2. Description of the Related Art

Generally, a PDP is a display device in which vacuum ultraviolet rays emitted from the plasma generated by gas discharge excite phosphors to emit red, green, and blue visible light and thereby realize predetermined images. The PDP can make a large-scale screen of more than 60 inches with a thickness of less than 10 cm (centimeters), and since it is a self emission display device, the PDP is characterized in that there is no distortion due to view angle and it has outstanding color reproduction. Moreover, its manufacturing process is simpler than that of an LCD, so the PDP has advantages in productivity and cost. Accordingly, this PDP has been highlighted for televisions and flat panel displays for industrial purposes.

A conventional AC PDP includes address electrodes formed along one direction (the X-axis direction of the drawing) on the second substrate, and a dielectric layer formed on an entire surface of the second substrate covering the address electrodes. Over the dielectric layer, a plurality of barrier ribs in a stripe pattern are formed between each of the address electrodes, and phosphor layers of red, green, and blue are formed between each of the barrier ribs.

Further, display electrodes comprised of a pair of transparent electrodes and and a pair of bus electrodes and along the direction intersecting the address electrodes (in the Y-axis direction of the drawing), are formed on a surface of the first substrate opposing the second substrate. A dielectric layer and an MgO protective layer are formed sequentially covering the display electrodes.

Discharge cells are defined in the region where the address electrodes on the second substrate intersect a pair of the display electrodes on the first substrate.

In a PDP with the above structure, more than a million matrix type discharge cell units are arranged. To simultaneously drive matrix type discharge cells of an AC PDP, a memory characteristic is used.

Upon driving, discharge of the AC PDP mostly involves two factors, one of which is a wall charge, and the other uses so-called priming particles.

Since barrier ribs physically separate the unit cells, each cell can discharge independently. However, in reality, many priming particles move freely through the narrow space between the top portion of the barrier ribs and the first substrate. Sometimes the amount of movement is enough to cause a mis-discharge, but this is very unusual. In most cases, the PDP is operated within a range where the mis-discharge does not occur. These priming particles moving through the narrow space between the first substrate and the barrier ribs make it easier for the next discharge to occur.

However, the outermost discharge cells placed adjacent to the edges of the PDP have a disadvantage for driving since the amount of priming particles to be accepted by them is decreased compared with the discharge cells at the center portion (because the adjacent discharge cells exist only at one side thereof), and accordingly, the driving margin of the outermost discharge cells become unstable when the panel is driven.

SUMMARY OF THE INVENTION

One aspect of the present invention provides a plasma display panel in which expanded portions are formed in regions of address electrodes that correspond to outermost discharge cells to improve stability in the address discharge to the discharge cells.

It is another object of the present invention to provide a plasma display panel that is easier and more cost effective to manufacture and yet be more stable, efficient and easier to implement.

It is yet another object of the present invention to provide a plasma display panel accommodating the maintaining of a driving voltage margin to be uniform on the overall surface of the panel.

A plasma display panel according to the present invention includes a first substrate and a second substrate opposing each other; display electrodes formed along one direction on the first substrate, being parallel to one another; address electrodes formed on the second substrate along the direction intersecting the display electrodes, and being parallel to one another; barrier ribs arranged in the space between the first substrate and the second substrate to define a plurality of discharge cells; and phosphor layers formed in each of the discharge cells. Then, expanded portions are formed in the regions of the address electrodes that correspond to the outermost discharge cells adjacent to the edges of both of the substrates.

The expanded portions can be formed in the beginning region and the end region of each of the address electrodes, and among a plurality of the address electrodes parallel to one another, the widths of the first line and the last line of the address electrodes are greater than those of the remaining lines of the address electrodes.

In another exemplary embodiment according to the present invention, first expanded portions are formed in the regions of the address electrodes corresponding to each of the discharge cells, and second expanded portions, being larger in width than the first expanded portions, are formed in the regions of the address electrodes that correspond to the outermost discharge cells adjacent to the edges of both of the substrates.

The second expanded portions can be formed in the beginning region and the end region of each of the address electrodes, and among a plurality of the address electrodes parallel to one another, and the second expanded portions can be formed in the regions of the first line and the last line of the address electrodes that correspond to each of the discharge cells.

As described above, the plasma display panel according to the present invention has the expanded portions formed in the regions of the address electrodes that correspond to the outermost discharge cells so that a greater amount of wall charge is generated within the discharge cells which improves the stability in the address discharge to the discharge cells. Accordingly, as priming particles are compensated into the discharge cells adjacent to the edge of the panel where priming particles are relatively insufficient, the instability of address discharge at that region can be improved, thereby enabling maintaining of the driving voltage margin to be uniform on the overall surface of the panel.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 7:
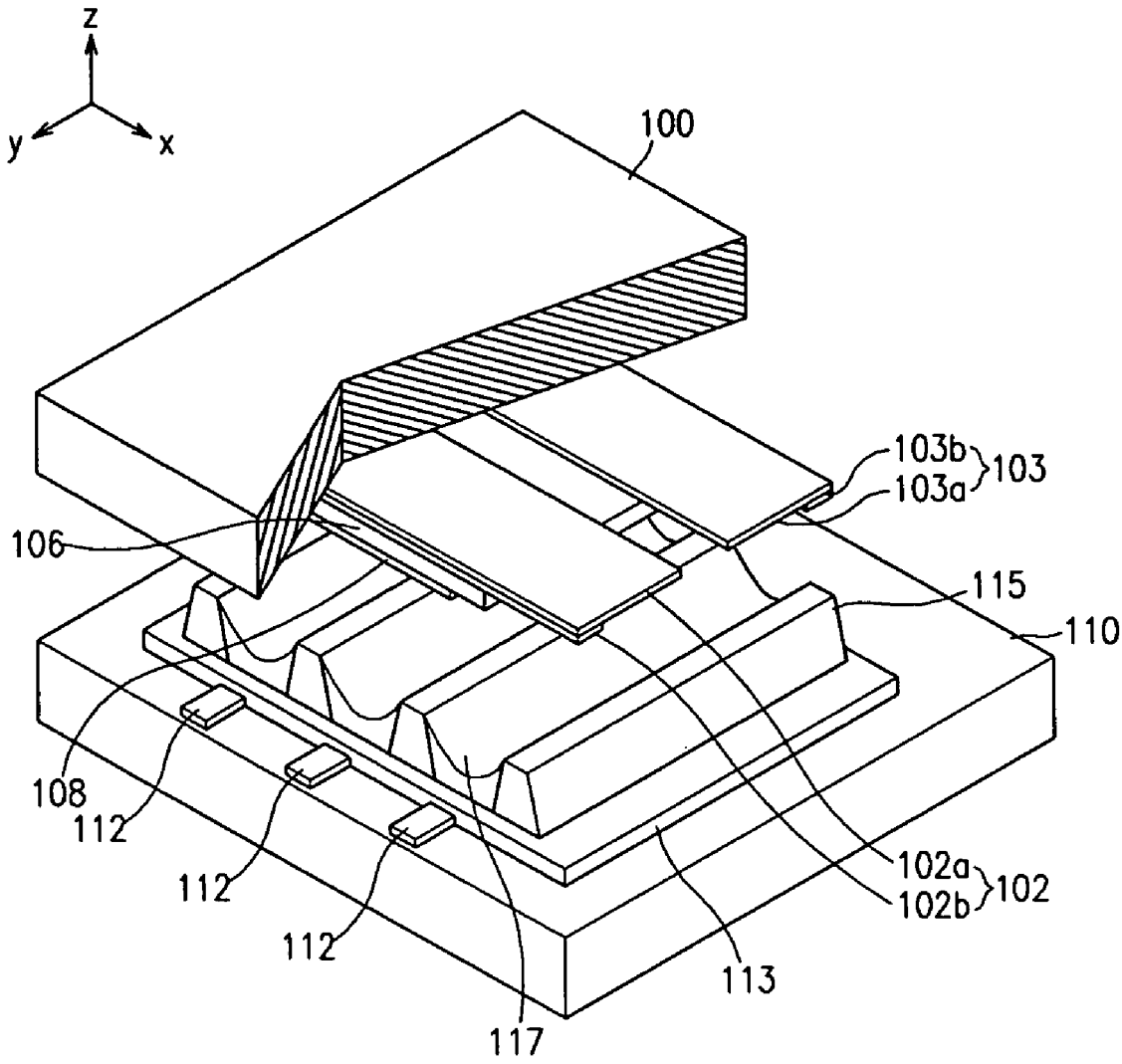
FIG. 7 is a cross-sectional view of a conventional PDP.

Turning now to the drawings, with reference to FIG. 7, a conventional AC PDP includes address electrodes 112 formed along one direction (the X-axis direction of the drawing) on the second substrate 110, and a dielectric layer 113 formed on an entire surface of the second substrate 110 covering the address electrodes 112. Over the dielectric layer 113, a plurality of barrier ribs in a stripe pattern are formed between each of the address electrodes 112, and phosphor layers 117 of red, green, and blue are formed between each of the barrier ribs 115.

Further, display electrodes 102 and 103 comprised of a pair of transparent electrodes 102*a* and 103*a* and a pair of bus electrodes 102*b* and 103*b* along the direction intersecting the address electrodes 112 (in the Y-axis direction of the drawing), are formed on a surface of the first substrate 100 opposing the second substrate 110. A dielectric layer 106 and an MgO protective layer 108 are formed sequentially covering the display electrodes 102 and 103.

Discharge cells are defined in the region where the address electrodes 112 on the second substrate 110 intersect a pair of the display electrodes 102 and 103 on the first substrate 100.

An exemplary embodiment of the present invention will now be described in detail with reference to the accompanying drawings.

Figure 1:
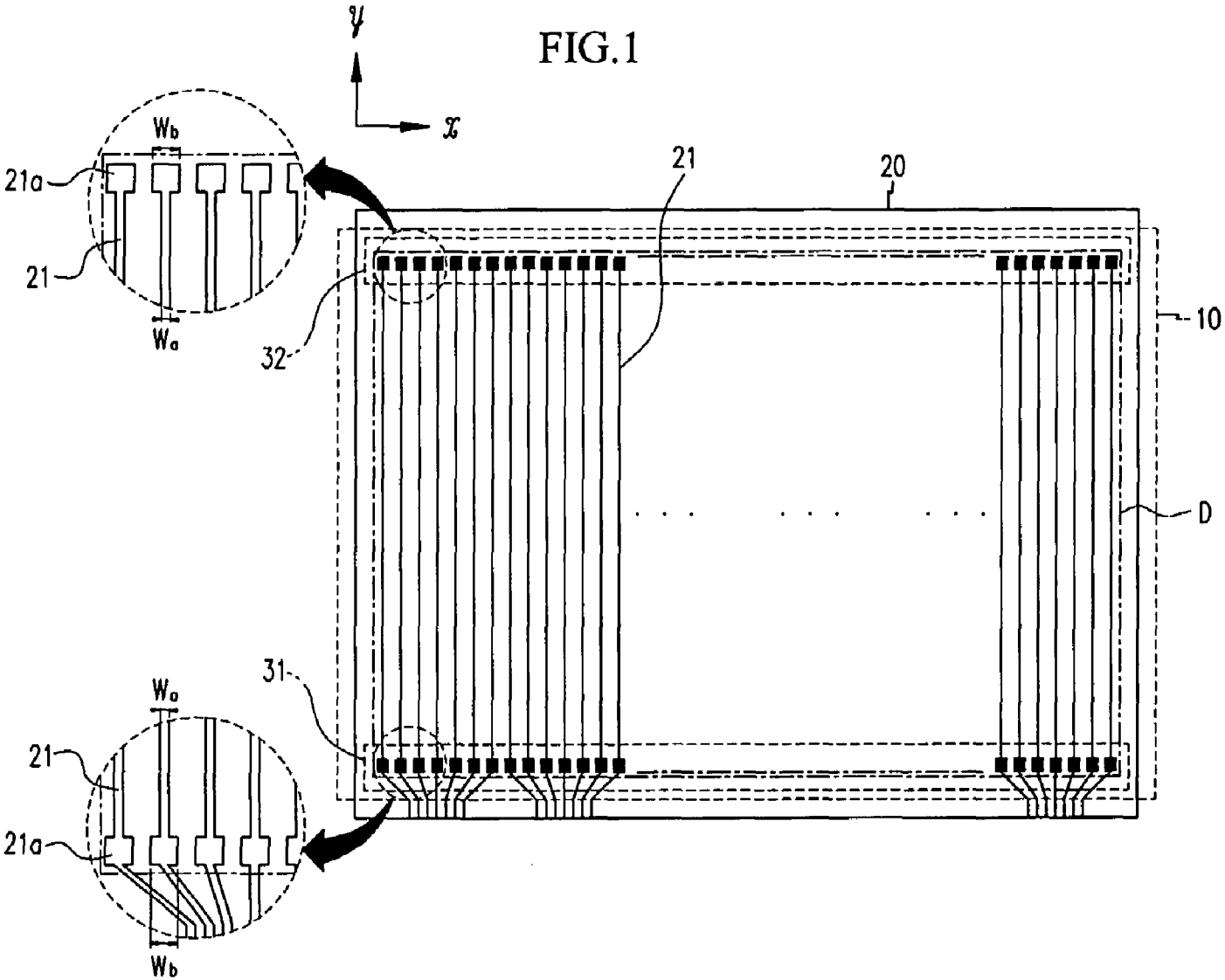
FIG. 1 is a schematic view of a plasma display panel having the address electrodes according to the first exemplary embodiment of the present invention.

FIG. 1 is a schematic view of a plasma display panel (PDP) having the address electrodes according to the first exemplary embodiment of the present invention.

With reference to FIG. 1, the plasma display panel according to an exemplary embodiment of the present invention includes a plurality of address electrodes 21 that are formed on the second substrate along one direction of the second substrate (in the Y-axis direction of the drawing), and a plurality of display electrodes (not shown in the drawing) that are formed along the direction intersecting the address electrodes (in the X-axis direction of the drawing). The display electrodes include sustain electrodes (X electrodes) and scan electrodes (Y electrodes), and discharge cells are defined in the regions where the address electrodes intersect the display electrodes.

A plurality of barrier ribs (not shown in the drawing) are formed in the space between the second substrate 20 and the first substrate 10, and these barrier ribs are respectively arranged between the adjacent address electrodes 21 and define the discharge cells (not shown in the drawing) that are needed for plasma discharge. The discharge cells (not shown on the drawing) correspond to the discharge areas defined by the address electrodes 21 and the display electrodes.

In the present exemplary embodiment, expanded portions 21 a are formed in the beginning region 31 and the end region 32 of the address electrodes 21. That is, the expanded portions are formed in the beginning and in the end of the substantial address electrodes 21 within display areas D for reproducing images, while excluding terminal portions of the address electrodes 21 which are extended from each end portion arranged in the stripe pattern and connected to the driving circuit (not shown on the drawing) to apply the signal voltage for driving.

The width Wb of the expanded portion 21*a* of the address electrodes is formed to be larger than the width Wa of the other regions of the address electrodes.

The address electrodes 21 generate wall charges by opposed discharge with the display electrodes, especially the scan electrodes (Y electrodes), to prepare sustain discharge of the selected discharge cells for displaying images. Thus, with the expanded portion 21*a* described above, a greater amount of wall charge in the discharge cells 21 can be generated. Accordingly, as priming particles are compensated into the discharge cells adjacent to the edge of the panel where priming particles are relatively insufficient, the instability of address discharge at those regions can be improved, thereby enabling maintaining the driving voltage margin uniformly on the overall surface of the panel.

Figure 2:
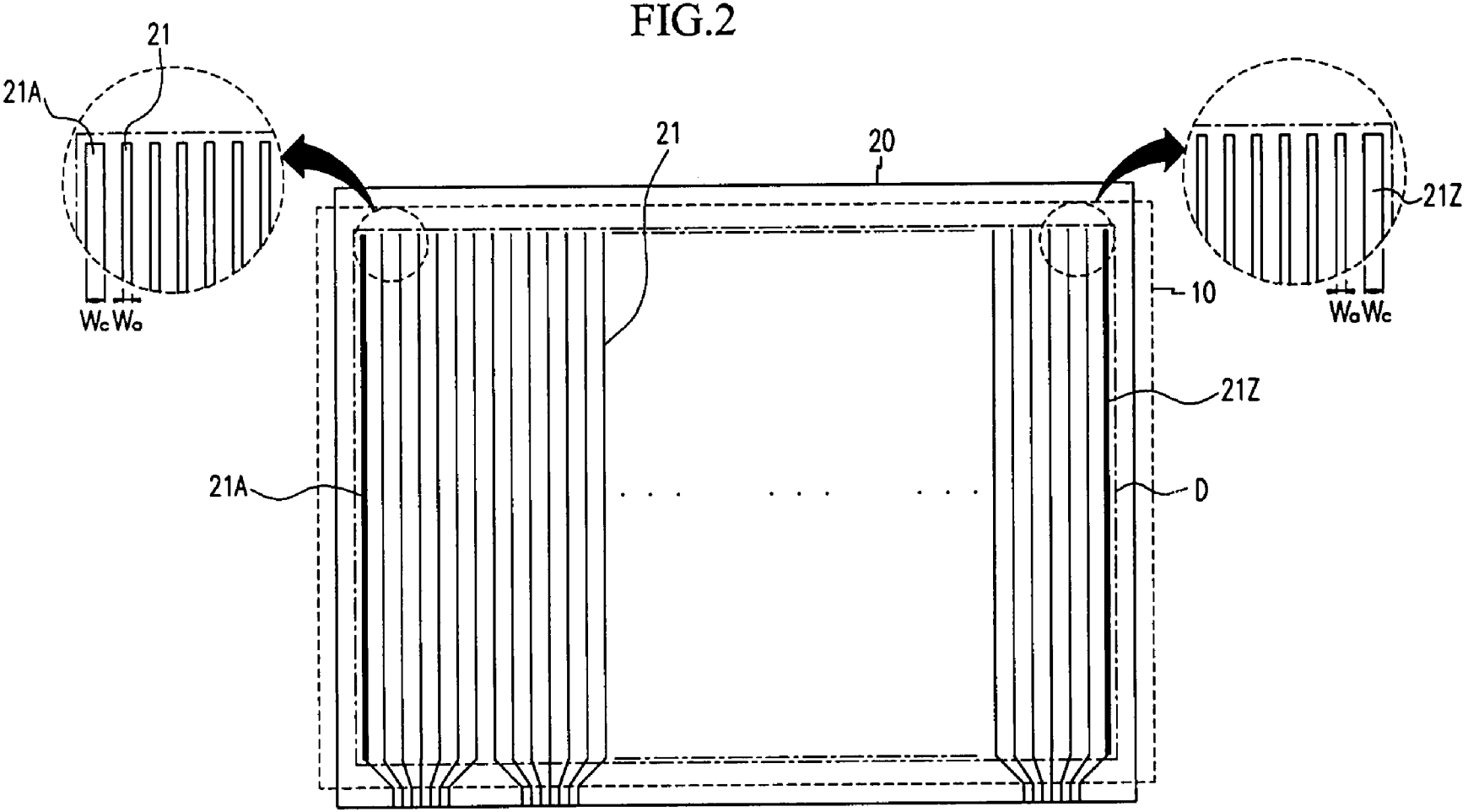
FIG. 2 is a schematic view of a plasma display panel having the address electrodes according to the second exemplary embodiment of the present invention.

FIG. 2 is a schematic view of a plasma display panel (PDP) having the address electrodes according to the second exemplary embodiment of the present invention.

According to FIG. 2, in the exemplary embodiment, among a plurality of the address electrodes 21 parallel to one another, the widths Wc of the first line 21A and the last line 21Z are greater than the width Wa of the remaining lines of the address electrodes 21. The above 21A and 21Z mean only that they are the first and the last lines, and they do not indicate that the number of address electrodes is the same as the number of letters in the alphabet.

Figure 3:
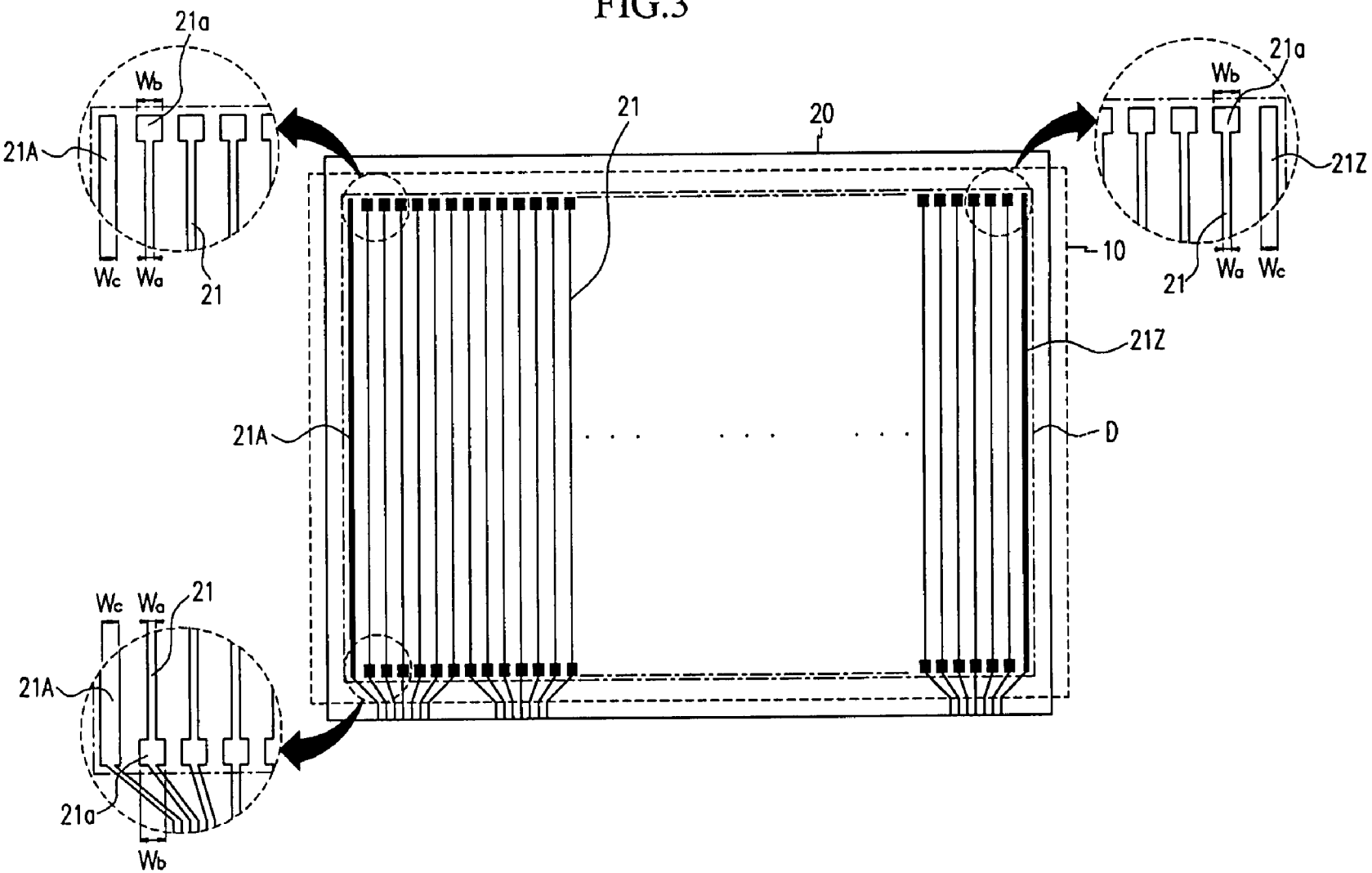
FIG. 3 is a schematic view of a plasma display panel having the address electrodes according to the third exemplary embodiment of the present invention.

FIG. 3 is a schematic view of a plasma display panel (PDP) having the address electrodes according to the third exemplary embodiment of the present invention.

According to FIG. 3, the plasma display panel of the third exemplary embodiment has all the characteristics of the first and the second exemplary embodiments, in which expanded portions are formed in the beginning region 31 and the end region 32 of each of the address electrodes 21, and among a plurality of the address electrodes 21 parallel to one another, and the widths Wc of the first line 21A and the last line 21Z of the address electrodes are greater than the width Wa of the remaining lines of the address electrodes 21.

Figure 4:
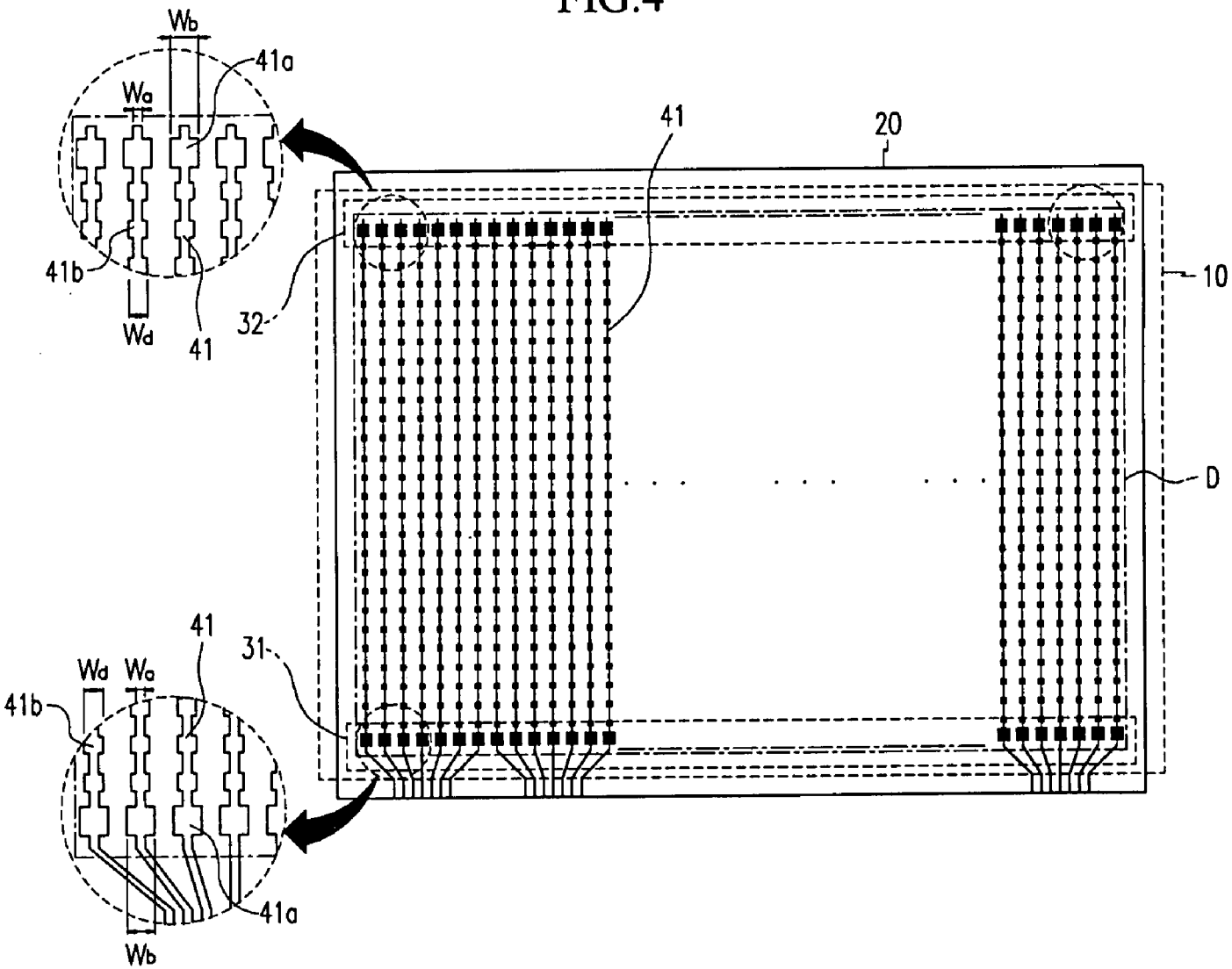
FIG. 4 is a schematic view of a plasma display panel having the address electrodes according to the fourth exemplary embodiment of the present invention.

FIG. 4 is a schematic view of a plasma display panel (PDP) having the address electrodes according to the fourth exemplary embodiment of the present invention.

With reference to FIG. 4, in this fourth exemplary embodiment, the first expanded portions 41*b* are formed in the regions of each of the address electrodes 41 that correspond to each discharge cell (not shown in the drawing). These first expanded portions 41 enable generation of more wall charge than when using opposed discharge with the scan electrodes (Y electrodes) of the display electrodes, which allows the discharge to occur more easily.

In addition, the second expanded portions 41*a* are formed in the beginning region and the end region of each of the address electrodes 21, and the width Wb of the second expanded portions 41*a* is greater than the width Wd of the first expanded portions 41*b*, and the width Wd of the first expanded portions 41*b* is greater than the width Wa of the address electrodes that correspond to non-discharge areas.

Figure 5:
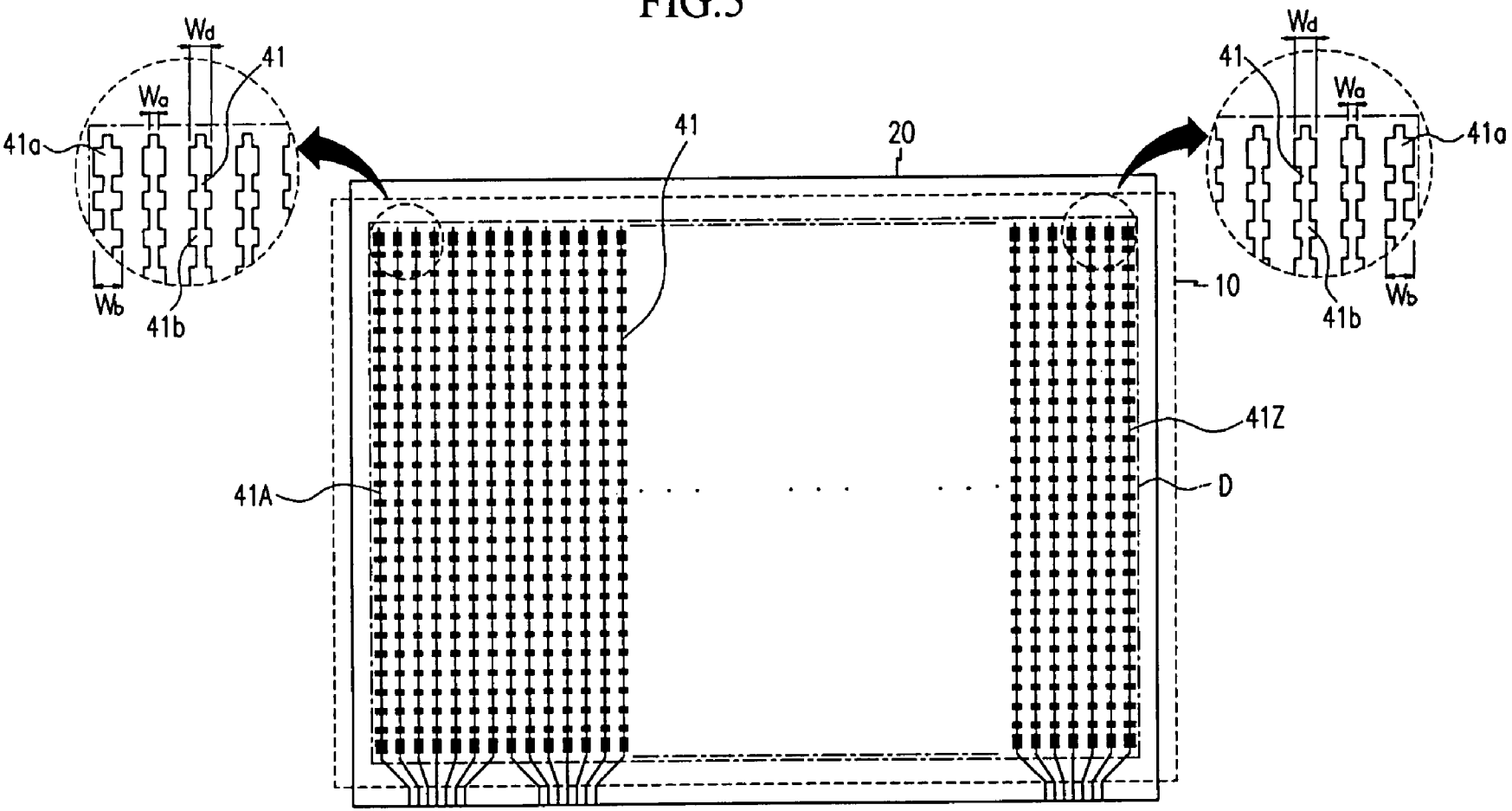
FIG. 5 is a schematic view of a plasma display panel having the address electrodes according to the fifth exemplary embodiment of the present invention.

FIG. 5 is a schematic view of a plasma display panel (PDP) having the address electrodes according to the fifth exemplary embodiment of the present invention.

According to FIG. 5, in this fifth exemplary embodiment, among a plurality of the address electrodes 41 parallel to one another, the second expanded portions 41*a* are formed in the regions of the first line 41A of the address electrodes and the last line 41Z of the address electrodes that correspond to each of the discharge cells. The first expanded portions 41*b* are formed in the regions of the remaining address electrodes that correspond to each of the discharge cells. As in the fourth exemplary embodiment, the width Wb of the second expanded portions 41*a* is greater than the width Wd of the first expanded portions 41*b*, and the width Wd of the first expanded portions 41*b* is greater than the width Wa of the address electrodes that correspond to non-discharge areas.

Figure 6:
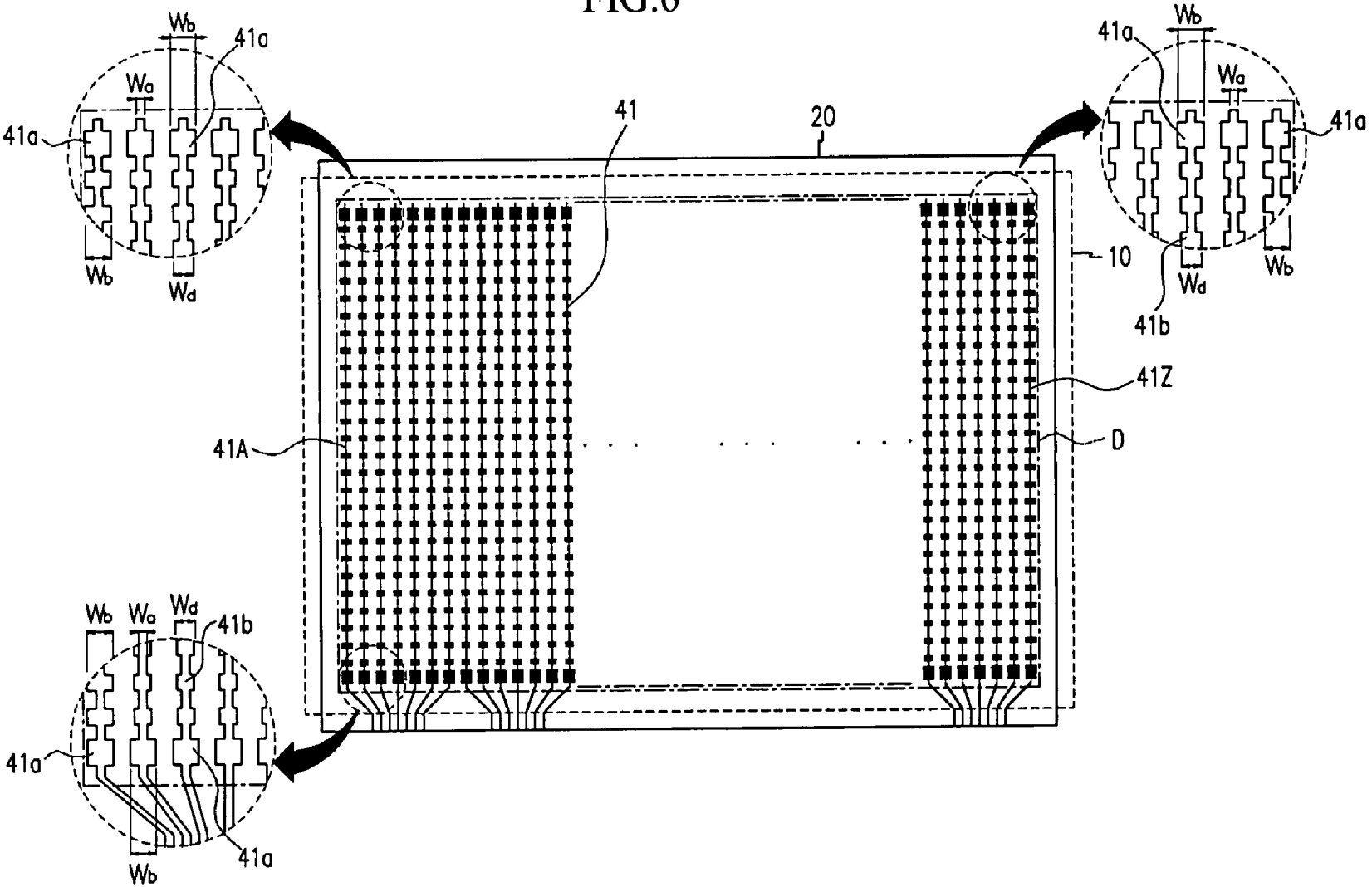
FIG. 6 is a schematic view of a plasma display panel having the address electrodes according to the sixth exemplary embodiment of the present invention.

FIG. 6 is a schematic view of a plasma display panel (PDP) having the address electrodes according to the sixth exemplary embodiment of the present invention.

According to FIG. 6, the plasma display panel of the sixth exemplary embodiment has all the characteristics of the fourth and the fifth exemplary embodiments, in which first expanded portions 41*b* are formed in the regions of the address electrodes 41 that correspond to each of the discharge cells (not shown in the drawing), and the second expanded portions are formed in the beginning region 31 and the end region 32 of each of the address electrodes 21. In addition, among a plurality of the address electrodes 41 parallel to one another, the second expanded portions 41*a* are formed in the regions of the first line 41A of the address electrodes and the last line 41Z of the address electrodes that correspond to each of the discharge cells.

The width Wb of the second expanded portions 41*a* is formed to be greater than the width Wd of the first expanded portions 41*b*, and the width Wd of the first expanded portions 41*b* is formed to be greater than the width Wa of the address electrodes that correspond to non-discharge areas.

Although embodiments of the present invention have been described in detail hereinabove in connection with certain exemplary embodiments, it should be understood that the invention is not limited to the disclosed exemplary embodiment, but, on the contrary is intended to cover various modifications and/or equivalent arrangements included within the spirit and scope of the present invention, as defined in the appended claims.

What is claimed is:

1. A plasma display panel, comprising:

a first substrate and a second substrate opposing each other;

display electrodes arranged along one direction on said first substrate, the display electrodes being parallel to one another;

address electrodes arranged on said second substrate along a direction intersecting said display electrodes, the address electrodes being parallel to one another;

barrier ribs arranged in a space between said first substrate and said second substrate to define a plurality of discharge cells within a display area of the panel; and phosphor layers arranged in each of the discharge cells;

wherein expanded portions are formed in regions of said address electrodes within the display area in discharge cells adjacent to edges of both said first and second substrates; and wherein said address electrodes are arranged as lines, and wherein widths of first and last lines of said address electrodes are greater than widths of remaining lines of said address electrodes.

2. The plasma display panel of claim 1, wherein said expanded portions are arranged in beginning and end regions of each of said address electrodes.

3. The plasma display panel of claim 1, wherein said address electrodes include expanded portions at one end thereof and other expanded portions at an opposite end thereof.

4. The plasma display panel of claim 1, wherein the widths of the first line, the last line and the remaining lines of said address electrodes are equal to widths of a substantial portion of said address electrodes.

5. The plasma display panel of claim 1, wherein said address electrodes includes the line, and the remaining lines of said address electrodes including expanded portions at each end of the remaining lines.

6. A plasma display panel, comprising:

a first substrate and a second substrate opposing each other;

display electrodes formed along one direction on said first substrate, being parallel to one another;

a plurality of address electrodes formed on said second substrate along the direction intersecting the display electrodes, and being parallel to one another;

the address electrodes are arranged as lines, and widths of first and last lines of said plurality of address electrodes are greater than width of remaining lines of the address electrodes;

barrier ribs arranged in a space between said first substrate and said second substrate to define a plurality of discharge cells; and phosphor layers formed in each of said discharge cells, wherein first expanded portions are formed in the regions of each of said address electrodes that correspond to each of said discharge cells, wherein second expanded portions, being larger in width than said first expanded portions, are formed in the regions of said address electrodes that correspond to the outer-most discharge cells adjacent to the edges of both of said first and second substrates.

7. The plasma display panel of claim 6, wherein said second expanded portions are formed in the beginning region and the end region of each address electrode.

8. The plasma display panel of claim 6, wherein among said plurality of address electrodes parallel to one another, the second expanded portions are formed in the regions of the first line and the last line of the address electrodes that correspond to each of the discharge cells.

9. A plasma display panel, comprising:

a first substrate and a second substrate opposing each other and accommodating a plurality of discharge cells;

a plurality of display electrodes arranged along one direction on said first substrate, the plurality of display electrodes being parallel to one another; and a plurality of address electrodes arranged on said second substrate along a direction intersecting said display electrodes, said address electrodes including expanded portions in regions thereof within a display area of the panel in discharge cells adjacent to edges of both said first and second substrates; and wherein the address electrodes are arranged as lines and wherein widths of first and last lines of said plurality of address electrodes are greater than widths of remaining lines of the address electrodes.

10. The plasma display panel of claim 9, further comprising a second set of expanded portions formed in the regions of each of said address electrodes that correspond to each discharge cell.

11. The plasma display panel of claim 10, further comprised of the width of said expanded portions being greater than the width of the second set of expanded portions.

12. The plasma display panel of claim 11, with the width of the second set of expanded portions being greater than the width of said address electrodes that correspond to non-discharge areas.

13. The plasma display panel of claim 9, with the expanded portions being formed in the regions of the first line of said address electrodes and the last line of said address electrodes that correspond to each of the discharge cells and another set of expanded portions being formed in the regions of the remaining address electrodes that correspond to each of said discharge cells.

14. The plasma display panel of claim 13, further comprised of the width of the expanded portions being greater than the width of the outer set of expanded portions.

15. The plasma display panel of claim 14, with the width of the other set of expanded portions being greater than the width of the address electrodes that correspond to non-discharge areas.

16. The plasma display panel of claim 9, further comprised of said expanded portions being formed in the beginning region and the end region of each of said address electrodes, and said expanded potions being formed in the regions of the first line of said address electrodes and the last line of said address electrodes that correspond to each of said discharge cells while another set of expanded portions being formed in the regions of said address electrodes that corresponds to each of the discharge cells.

17. The plasma display panel of claim 16, further comprised of the width of the expanded portions being greater than the width of the other set of expanded portions.

18. The plasma display panel of claim 17, with the width of the other set of expanded portions being greater than the width of the address electrodes that correspond to non-discharge areas.

19. The plasma display panel of claim 9, wherein said expanded portions are arranged in beginning and end regions of said address electrodes.

20. The plasma display panel of claim 9, wherein widths of said expanded portions of said address electrodes are greater than widths of other regions of said address electrodes.

21. A plasma display panel, comprising:

a first substrate and a second substrate opposing each other;

a plurality of display electrodes arranged along one direction on said first substrate, the display electrodes being parallel to one another; and a plurality of address electrodes arranged on said second substrate along a direction intersecting said display electrodes, each of said plurality of address electrodes forming a line;

wherein widths of first and last lines of said plurality of address electrodes are greater than widths of remaining lines of address electrodes.

* * * * *